US010252890B2

(12) United States Patent
Ratia et al.

(10) Patent No.: US 10,252,890 B2
(45) Date of Patent: Apr. 9, 2019

(54) METHOD FOR INSTALLING AN ELEVATOR IN THE CONSTRUCTION PHASE OF A BUILDING

(71) Applicant: Kone Corporation, Helsinki (FI)

(72) Inventors: Jouni Ratia, Hyvinkaa (FI); Antti Mertala, Hyvinkaa (FI)

(73) Assignee: Kone Corporation, Helsinki (FI)

( * ) Notice: Subject to any disclaimer, the term of this patent is extended or adjusted under 35 U.S.C. 154(b) by 0 days.

(21) Appl. No.: 15/907,813

(22) Filed: Feb. 28, 2018

(65) Prior Publication Data

US 2018/0186607 A1 Jul. 5, 2018

Related U.S. Application Data

(63) Continuation of application No. PCT/FI2015/050641, filed on Sep. 25, 2015.

(51) Int. Cl.
*B66B 19/00* (2006.01)

(52) U.S. Cl.
CPC ..... *B66B 19/00* (2013.01)

(58) Field of Classification Search
CPC ..... B66B 19/00; B66B 11/0045
See application file for complete search history.

(56) References Cited

U.S. PATENT DOCUMENTS 6,364,067 B1 * 4/2002 Glassey ..... B66B 7/027 187/408
8,291,568 B2 * 10/2012 Barneman ..... B66B 19/00 187/414

(Continued)

FOREIGN PATENT DOCUMENTS

CN 104024141 A 9/2014
EP 1785386 A1 * 5/2007 ..... B66B 9/187

(Continued)

OTHER PUBLICATIONS

International Search Report PCT/ISA/210 for International Application No. PCT/FI2015/050641 dated Sep. 25, 2015.

(Continued)

*Primary Examiner* — Jeanette E Chapman
(74) *Attorney, Agent, or Firm* — Harness, Dickey & Pierce, P.L.C.

(57) ABSTRACT

The object of the invention is a method for installing an elevator in the construction phase of a building. The elevator comprises an elevator car adapted to move reciprocally in an elevator hoistway in the construction phase and a compensating weight, which is connected via a suspension beam to support the elevator car by means of at least one suspension member and also by means of diverting pulleys. The elevator has a temporary hoisting machine provided with a traction sheave, the hoisting machine being kept in its position for the whole duration of the construction phase of the building, and a traction member, such as a belt, rope or chain, which is adapted to transmit the rotational movement of the traction sheave into movement of the elevator car and of the compensating weight. During the construction time, the supporting and the moving of the elevator car are separated from each other. When taking the elevator into normal operation when the building is at its final height, the construction-time hoisting machine with its traction sheave and traction member is removed, and the new hoisting machine plus traction sheave and hoisting roping is installed into position.

11 Claims, 4 Drawing Sheets

(56) References Cited

U.S. PATENT DOCUMENTS

Figure 1:
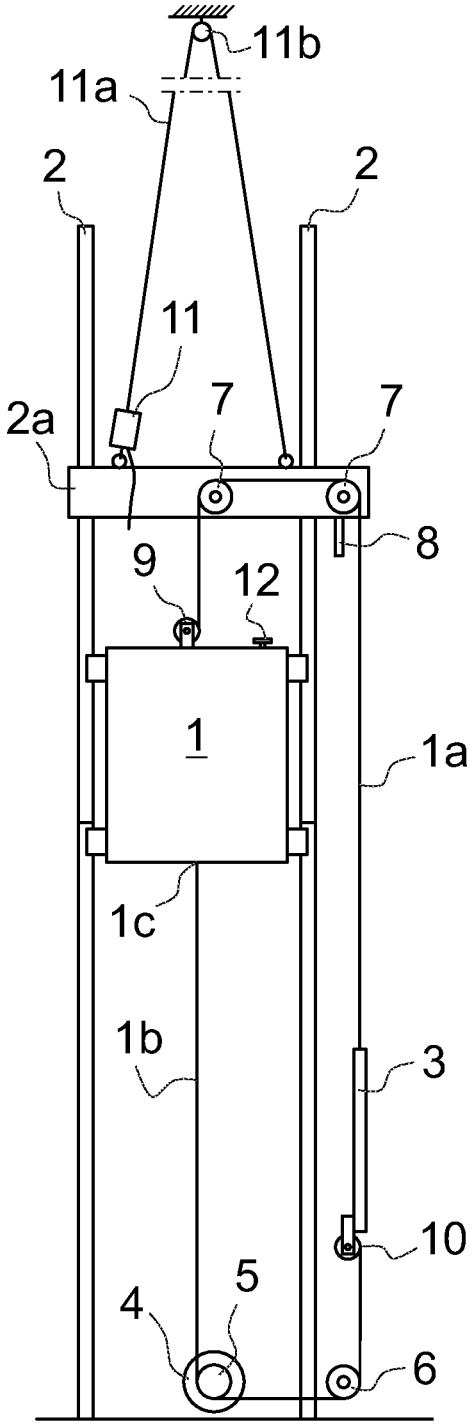

| | | | | |
|---|---|---|---|---|
| 9,415,974 | B2 * | 8/2016 | Perala | B66B 11/0484 |
| 9,834,415 | B2 * | 12/2017 | Hense | B66B 19/00 |
| 2007/0137946 | A1 * | 6/2007 | Aulanko | B66B 19/002 187/404 |
| 2008/0308362 | A1 * | 12/2008 | Tucker | B66B 19/00 187/414 |
| 2009/0223751 | A1 * | 9/2009 | Peacock | B66B 7/027 187/414 |
| 2011/0113720 | A1 * | 5/2011 | Peacock | B66B 19/00 52/741.1 |
| 2012/0023863 | A1 * | 2/2012 | Van Der Meijden | B66B 19/00 52/741.1 |
| 2012/0291395 | A1 * | 11/2012 | Plathin | B66B 19/00 52/741.1 |
| 2013/0118838 | A1 * | 5/2013 | Plathin | B66B 19/02 187/251 |
| 2013/0248299 | A1 * | 9/2013 | Perala | B66B 19/00 187/359 |
| 2014/0231179 | A1 * | 8/2014 | Alasentie | B66B 11/0045 187/251 |
| 2014/0231180 | A1 * | 8/2014 | Kallioniemi | B66B 11/0045 187/256 |
| 2018/0127244 | A1 * | 5/2018 | Fauconnet | B66B 17/12 |

FOREIGN PATENT DOCUMENTS

| | | | | |
|---|---|---|---|---|
| FR | 2823734 | A1 * | 10/2002 | B66B 11/009 |
| JP | H03267283 | A | 11/1991 | |
| JP | H10250958 | A | 9/1998 | |
| WO | WO-9943596 | A2 * | 9/1999 | B66B 11/004 |
| WO | WO-03086937 | A1 * | 10/2003 | B66B 11/009 |
| WO | WO-2004113218 | A1 * | 12/2004 | B66B 11/0015 |
| WO | WO-2009073010 | A1 * | 6/2009 | B66B 19/00 |
| WO | WO-2010139845 | A1 | 12/2010 | |
| WO | WO-2011080387 | A1 * | 7/2011 | B66B 19/00 |
| WO | WO-2011148033 | A1 | 12/2011 | |
| WO | WO-2012072860 | A1 * | 6/2012 | B66B 19/00 |
| WO | WO-2012089896 | A1 | 7/2012 | |
| WO | WO-2013079790 | A1 * | 6/2013 | B66B 11/0045 |
| WO | WO-2013110850 | A1 * | 8/2013 | B66B 7/062 |
| WO | WO-2016126933 | A1 * | 8/2016 | B66B 11/0213 |

OTHER PUBLICATIONS

Written Opinion of the International Searching Authority PCT/ISA/237 for International Application No. PCT/FI2015/050641 dated Sep. 25, 2015.

Office Action dated Dec. 27, 2018 by the Chinese Patent Office for Application No. CN 201580083321.5.

* cited by examiner

METHOD FOR INSTALLING AN ELEVATOR IN THE CONSTRUCTION PHASE OF A BUILDING

This application is a continuation of PCT International Application No. PCT/FI2015/050641 which has an International filing date of Sep. 25, 2015, the entire contents of which are incorporated herein by reference.

The object of the invention is a method, as presented in the preamble of claim 1, for installing an elevator in the construction phase of a building.

Elevators are generally already needed in high-rise buildings already in the construction phase of the building, when the lower floors of the building are completed. In this case so-called jump-lifts are generally used, which enable use of the elevator in an unfinished elevator hoistway to as high in the building as the built floors allow. This type of jump-lift solution known in the art is, however, extremely complex and expensive because a temporary machine room plus associated machines and electrical connections are needed in it, which machine room is raised farther upwards from time to time as new floors are completed and the electrical connections have to be disconnected and reconnected in conjunction with each lift.

U.S. Pat. No. 5,033,586 presents one solution according to prior art, in which a temporary machine room module, formed from two decks and a frame connecting them, can be lifted to the desired height in the elevator hoistway and locked into its new position. The machine room module is disposed in the hoistway above the elevator car. The hoisting machine together with conventional machine room components and hoisting rope reels is disposed at a higher level than the module. When the machine room module is lifted upwards, the elevator car is locked into position and the additional length of hoisting ropes needed is taken from the reels from the top deck of the machine room module. A problem in this solution is that the whole amount of additional rope plus reels and also the machine room module with all its components must always be lifted upwards at the same time. In addition, the electrification must always be disconnected during a lift and reconnected when the machine room module has been lifted to its new position. Heavy-duty hoists are needed in the work due to the large masses and the whole installation job is slow and also dangerous. In addition, disassembly of the temporary machine room module at completion of installation produces a lot of waste material and also takes time.

The aim of the present invention is to eliminate the aforementioned drawbacks and to achieve an inexpensive and easy-to-implement method for installing an elevator in the construction phase of a building, said method enabling fast and safe installation. The method according to the invention is characterized by what is disclosed in the characterization part of claim 1. Other embodiments of the invention are characterized by what is disclosed in the other claims.

Some inventive embodiments are also discussed in the descriptive section of the present application. The inventive content of the application can also be defined differently than in the claims presented below. The inventive content may also consist of several separate inventions, especially if the invention is considered in the light of expressions or implicit sub-tasks or from the point of view of advantages or categories of advantages achieved. In this case, some of the attributes contained in the claims below may be superfluous from the point of view of separate inventive concepts. Likewise the different details presented in connection with each embodiment can also be applied in other embodiments. In addition it can be stated that at least some of the subordinate claims can, in at least some situations, be deemed to be inventive in their own right.

One advantage of the solution according to the invention is that in the construction phase the temporary hoisting machine of the elevator can be kept all the time in the same location in the bottom part of the elevator hoistway and likewise the electrical connection does not need to be disconnected and reconnected always in conjunction with a jump lift, i.e. in conjunction with a jump function. Another advantage is that the load to be lifted in conjunction with a jump function is significantly lighter than in current solutions according to prior art. In the solution according to the invention a smaller and more lightweight hoist can in this case be used for implementing the jump function. A further advantage of the solution is that it is significantly safer and faster than solutions that are currently known in the art.

In the method of the invention a construction-time elevator function is achieved in the construction phase of a building, the function having at least an elevator car adapted to move in an elevator hoistway, one or more compensating weights, which are for their part connected, via a suspension beam fixed above the elevator car, to support the elevator car by means of ropes or belts and also by means of a diverting pulley or diverting pulleys, and also a hoisting machine provided with one or more traction sheaves or corresponding, the hoisting machine being kept in its position in the construction phase, and at least one traction member, such as a belt, rope or chain, which is adapted to transmit the rotational movement of the traction sheave into movement of the elevator car and of the compensating weight in the direction of their trajectory, in which case in this elevator the supporting and the moving of the elevator car have been separated from each other. When taking the elevator into normal operation when the building is at its final height, the installation-time hoisting machine, i.e. the hoisting machine, plus traction sheave and traction member being held in position in the construction phase, is removed and the new hoisting machine plus traction sheave and hoisting roping is installed into position. The hoisting machine being kept in its position in the construction phase is disposed in the construction phase preferably in the proximity of the bottom part of the elevator track, most suitably in the bottom part or on the base of the elevator hoistway. The machine for the normal-drive elevator of the building will be in the top part of the elevator hoistway or in the proximity of the top part, most suitably in a machine room above the elevator hoistway. The elevator configuration in use during the construction time is well suited for lifting upwards from time to time according to the jump-lift concept. During the construction time of the building, the elevator car plus suspension beam is lifted by means of a so-called jump function to a new height position always after the building has reached the height of the next phase. After the building, or at least the part of the building comprising the elevator hoistway in question, has been completed to its final height, the new hoisting machine plus traction sheave is placed into position, preferably above the elevator car, and the elevator car is connected to the compensating weight by means of one or more hoisting ropes, which hoisting ropes are arranged to be driven by the hoisting machine on its traction sheave and to suspend the elevator car and the compensating weight or compensating weights. The elevator car and each compensating weight are preferably those that were used in the construction phase of the building or have been modified from them. Often it is advantageous to modernize the elevator car completely, at least in respect of the cabin.

Figure 2:
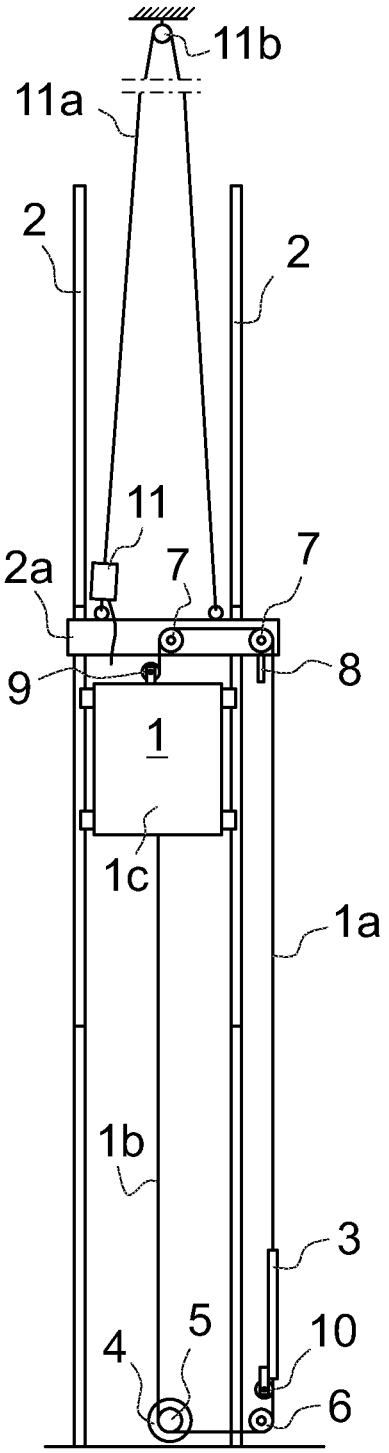
Figure 3:
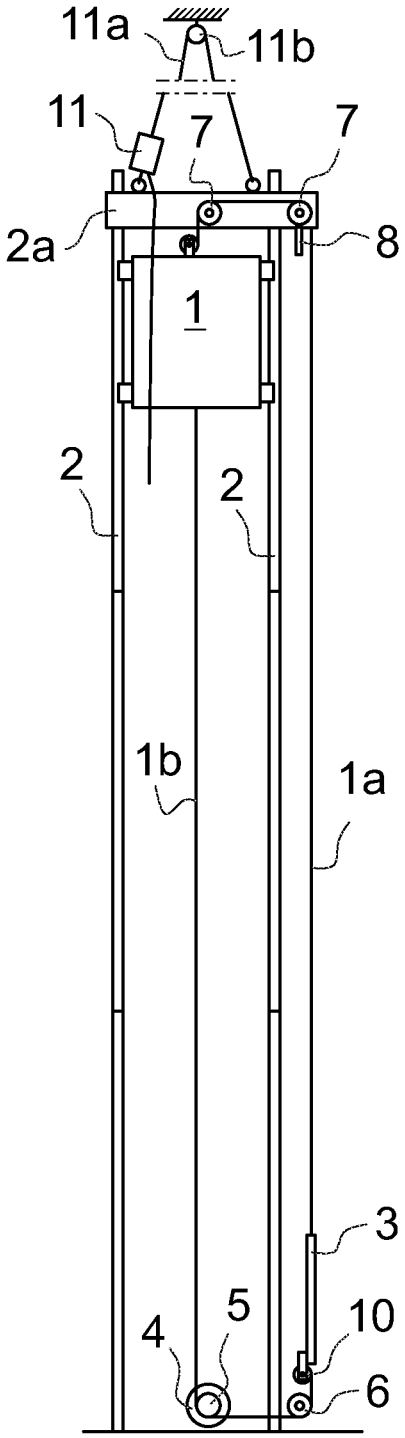
Figure 4:
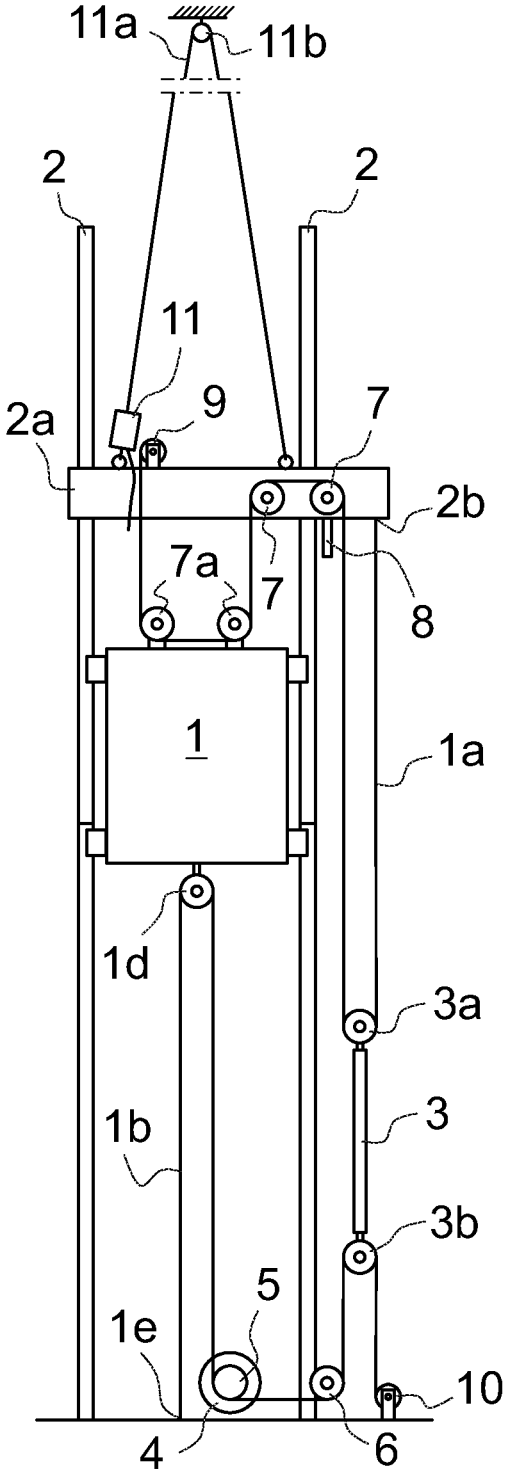
Figure 5:
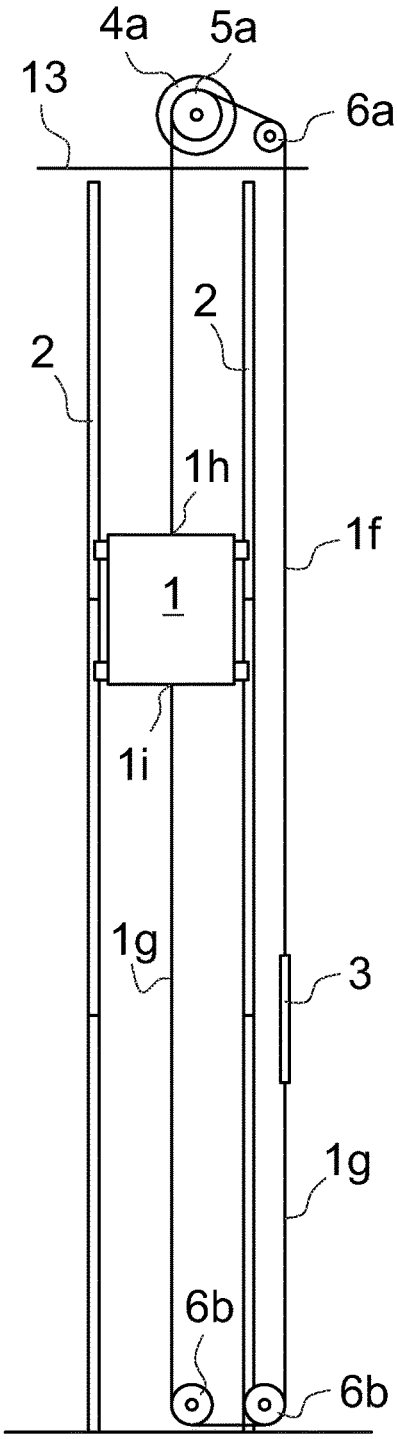
Figure 6:
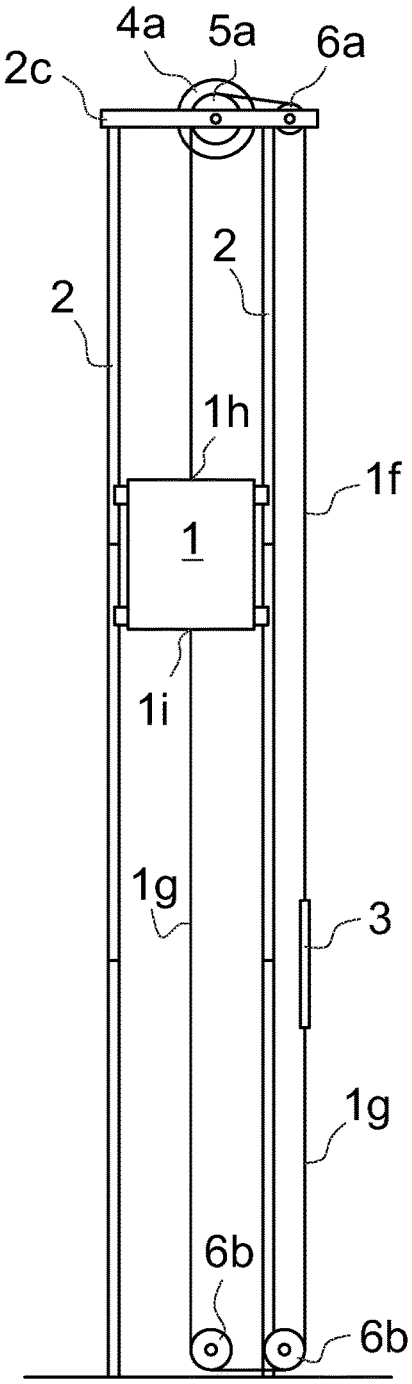

In the following, the invention will be described in more detail by the aid of some examples of its embodiment with reference to the simplified and diagrammatic drawings attached, wherein FIG. 1 presents a simplified and diagrammatic front view of one elevator arrangement according to the invention, wherein the elevator car can be used in normal drive in the elevator hoistway in the construction phase of the building, FIG. 2 presents a simplified and diagrammatic front view of the elevator arrangement according to FIG. 1, in which a jump function, i.e. a jump to a higher level, is in its starting phase, FIG. 3 presents a simplified and diagrammatic front view of the elevator arrangement according to FIG. 1, in which the jump to a higher level has just been done, FIG. 4 presents a simplified and diagrammatic front view of one other elevator arrangement according to the invention, wherein the elevator car can be used in normal drive in the elevator hoistway in the construction phase of the building, FIG. 5 presents a simplified and diagrammatic front view of one elevator arrangement according to the invention, wherein the elevator has been converted from construction-time use to final normal operation as an elevator with machine room above, and FIG. 6 presents a simplified and diagrammatic front view of one other elevator arrangement according to the invention, wherein the elevator has been converted from construction-time use to final normal as an elevator without machine room.

The method according to the invention is characterized in that a separate temporary machine room is not needed for performing jump functions nor is the hoisting machine lifted to anywhere during the jumps. A further essential point is that electrical connections do not need to be disconnected during the jumps and do not need to be reconnected again after the jumps.

FIG. 1 presents a simplified and diagrammatic front view of one elevator arrangement to be used in the method according to the invention, wherein the elevator car 1 can be used in normal drive in the elevator hoistway in the construction phase of the building.

In the solution according to the invention the elevator car 1 is arranged to travel upwards and downwards in the elevator hoistway guided by guide rails 2. The elevator car 1 is suspended with one or more suspension ropes 1*a* on a suspension beam 2*a* via the diverting pulleys 7 in such a way that the first ends of the suspension ropes 1*a* are fixed to the compensating weight 3, from where the suspension ropes 1*a* rise up and over the first and second diverting pulleys 7 and descend back towards the elevator car 1. The compensating weight 3 is arranged to travel upwards and downwards along its own guide rails as the elevator car 1 moves. For the sake of clarity the guide rails of the compensating weight 3 are not, however, presented in the figures. Instead of one or more compensating weights 3, one or more counterweights can also be used. Whenever hereinafter only one compensating weight 3 is mentioned, the simultaneous meaning intended is one or more compensating weights, or alternatively one or more counterweights.

After passing around the top of the second diverting pulley 7, the suspension ropes 1*a* descend to one or more feeder reels 9 for suspension rope, said reel(s) being fixed to the roof of the elevator car 1, from which reel(s) additional length for the suspension ropes is taken during a jump function being performed to a higher level. The designation first feeder reel is also used for the feeder reel 9 hereinafter. During normal operation of the elevator in the construction phase of the building the first feeder reel 9 is locked so that it does not rotate and the suspension ropes 1*a* are fixed with rope clamps, or in a corresponding manner, in such a way that the length of the suspension ropes 1*a* between the elevator car 1 and the compensating weight 3 does not unintentionally change. The overspeed governor 8 is fixed to the suspension beam 2*a* or preferably also to a guide rail 2.

In connection with the elevator car 1, e.g. on the roof of the elevator car 1, is also a pedal 12 of a bypass apparatus for the locking of the elevator car 1, by using which pedal the locking of the elevator car 1 implemented with the wedges of the safety gear can be temporarily removed, e.g. for performing a service drive. When pressing the pedal 12 and keeping the pedal 12 activated, i.e. pressed downwards, the locking-bypass apparatus detaches and keeps the safety gear wedges off the elevator guide rails 2, in which case the elevator car 1 can be driven e.g. on service drive.

In the construction phase of the building the supporting and the moving of the elevator car 1 are separated from each other. With the temporary hoisting machine 4, which is provided with one or more traction sheaves 5, service runs and normal runs are driven with the elevator car 1. The temporary hoisting machine 4 is disposed in the bottom part of the elevator hoistway below the elevator car 1 and likewise the electrification of the hoisting machine is in the bottom part of the elevator hoistway. The temporary hoisting machine 4 and its electrification are in the same location for essentially the whole duration of the installation of the elevator and, therefore, likewise for the whole construction time of the building. The traction member 1*b* is connected between the compensating weight 3 and the elevator car 1, from the bottom of one to the bottom of the other. The traction member 1*b* can be either an individual element or a plurality of parallel elements that are similar to each other. Whenever hereinafter only one traction member 1*b* is mentioned, the simultaneous meaning intended is one or more traction members, such as one or more toothed belts, chains, or some other type of elements that do not slide on the traction sheave 5.

The traction member 1*b* is on the feeder reel 10, which is fixed e.g. to the bottom part of the compensating weight 3. From the feeder reel 10 the traction member 1*b* has been led downwards around the bottom of the diverting pulley 6 that is in the bottom part of the elevator hoistway, from which diverting pulley 6 the traction member 1*b* has been led onwards around the bottom of the traction sheave 5 and from the traction sheave 5 onwards to its fixing point 1*c* on the bottom part or base of the elevator car 1, to which fixing point 1*c* the second end of the traction member 1*b* is fixed. The designation second feeder reel is also used for feeder reel 10 hereinafter. There can be more than one second reel 10, according to need.

During a jump to a higher level, the additional length needed for the traction member 1*b* is taken from the second feeder reel 10. During normal operation of the elevator in the construction phase of the building, the second feeder reel 10 is locked so that it does not rotate and the traction member 1*b* is fixed with rope clamps, or in a corresponding manner, in such a way that the length of the traction member 1*b* between the elevator car 1 and the compensating weight 3 does not unintentionally change.

The auxiliary hoist 11 to be used in the installation of the elevator is suspended by means of a hoisting rope 11*a* and a diverting pulley 11*b* on a fixed point in the building below the elevator car 1 in such a way that the auxiliary hoist 11 itself is fixed to the suspension beam 2*a* and the hoisting rope 11*a* of the auxiliary hoist 11 is led from the auxiliary hoist 11 over the top of the diverting pulley 11*b* back to the suspension beam 2*a*, to which the second end of the hoisting rope 11*a* is fixed. Here, the suspension ratio of the auxiliary hoist 11 is thus 2:1, but it could also just as well be 1:1. The auxiliary hoist is e.g. a TIRAK-type hoist, with the hoisting rope 11*a* passing through it. In conjunction with the lift the auxiliary hoist 11 remains fixed in its position and the length of the hoisting rope 11*a* between the auxiliary hoist 11 and the fixing point of the second end is shortened.

In the situation according to FIG. 1 the suspension beam 2*a* is fixed to the guide rails 2 of the elevator car 1 and the elevator can be used for normal drive. In this case it is not necessarily needed to have the auxiliary hoist 11 fixed into position, although it is presented thus in FIG. 1.

FIGS. 2 and 3 present the jump function, of the installation phase, i.e. a jump in the elevator arrangement presented by FIG. 1. In the situation presented by FIG. 2 the jump is in its starting phase and in the situation presented by FIG. 3 the jump is in its end phase, in which the jump to a higher level has just been done.

FIG. 4 presents one other elevator arrangement to be used in the method according to the invention, wherein the elevator car 1 can be used in normal drive in the elevator hoistway in the construction phase of the building. This solution differs from the solution according to FIGS. 1-3 in that both the suspension and the moving of the elevator car 1 now have a 2:1 ratio. In this case the first ends of the suspension ropes 1*a* are fixed to the fixing point 2*b* on the suspension beam 2*a*, from where the suspension ropes 1*a* are led downwards under the diverting pulley 3*a* that is on the top end of the compensating weight 3*a* and also back upwards over the first and second diverting pulleys 7 that are on the suspension beam 2*a* and again back downwards towards the elevator car 1, after passing around the bottom of the diverting pulleys 7*a* on the top part of which elevator car the suspension ropes 1*a* are again led to one or more first feeder reels 9 that is/are on the suspension beam 2*a*. This type of 2:1 suspension facilitates, inter alia, the feeding of additional length of suspension ropes 1*a* during a jump function, because the feeder reel 9 can easily be disposed in the most suitable possible location.

Correspondingly, in the solution according to FIG. 4, the traction ratio of the traction member 1*b* is also 2:1. In this case on the bottom part of the compensating weight 3 is a diverting pulley 3*b* and on the bottom part of the elevator car 1 is a diverting pulley 1*d*. The traction member 1*b* is led from one or more second feeder reels 10 fixed to the bottom part of the elevator hoistway upwards over the lowermost diverting pulley 3*b* of the compensating weight back to the bottom part of the elevator hoistway to pass under the diverting pulley 6 and the traction sheave 5 and after passing around the traction sheave 5 to ascend to the diverting pulley 1*d* on the bottom part of the elevator car, and after passing around the top of the diverting pulley 1*d* the traction member is led downwards to its fixing point 1*e* in the bottom part of the elevator hoistway. The feeder reel 10 of the traction member 1*b* and the fixing point 1*e* of the second end can also be vice versa, i.e. in this case the second feeder reel 10 is under the elevator car 1 and the fixing point 1*e* of the free end is below the counterweight 3. The solution according to a 2:1 traction ratio enables easy installation and operation of the feeder reel 10 during the construction time of the building.

In the situation according to FIG. 4, the suspension beam 2*a* is fixed to the guide rails 2 of the elevator car 1 and the elevator can be used for normal drive. In this case it is not necessarily needed to have an auxiliary hoist 11 fixed into position, although it is presented thus in FIG. 4. During normal operation of the elevator in the construction phase of the building the feeder reel 9 is locked so that it does not rotate and the suspension ropes 1*a* are fixed with rope clamps, or in a corresponding manner, in such a way that the length of the suspension ropes 1*a* between the elevator car 1 and the fixing point 2*b* of the first end of the suspension ropes does not unintentionally change. The overspeed governor 8 is fixed to the suspension beam 2*a* or preferably also to a guide rail 2.

The traction ratio of the traction member 1*b* of the elevator and the suspension ratio of the suspension ropes 1*a* can be the same as or also different to each other. In the case according to FIG. 1 the ratio of both is 1:1 and in the case according to FIG. 4 the ratio of both is 2:1. The ratios can also be such that the traction ratio of the traction member 1*b* is 1:1 but the suspension ratio of the suspension ropes 1*a* is 2:1, or the ratios can also be vice versa such that the traction ratio of the traction member 1*b* is 2:1 but the suspension ratio of the suspension ropes 1*a* is 1:1.

FIGS. 5 and 6 present a completed elevator installed by means of the solution according to the invention, in normal operation after completion of the building. FIG. 5 presents an elevator converted for normal operation into an elevator with machine room and FIG. 6 presents an elevator converted for normal operation into an elevator without machine room. The temporary hoisting machine 4, plus electrification and traction member 1*b* and suspension roping 1*a*, that has been in both elevators in the construction phase has been disassembled and the new hoisting machine 4*a* plus traction sheave 5*a* and hoisting roping 1*f* has been installed above the elevator car 1.

In the solution according to FIG. 5 the hoisting machine, with traction sheave 5*a*, is disposed in a machine room 12 that is above the elevator hoistway, the diverting pulley 6*a* also being disposed in the machine room. One or more hoisting ropes 1*f*, hereinafter for the sake of clarity only one hoisting rope 1*f* will be mentioned, is/are led from the compensating weight 3 upwards to the machine room 13 and over the diverting pulley 6*a* to the traction sheave 5, after passing around the top of which the hoisting rope 1*f* is led back down to the elevator car 1, onto which the second end of the hoisting rope 1*f* is fixed to its fixing point 1*h*. Correspondingly, the compensating rope 1*g* is led from the bottom part of the counterweight 3 to the elevator car 1 via a bottom route to pass first below one or more diverting pulleys 6*b* that are in the bottom part of the elevator hoistway and to ascend from the diverting pulley 6*b* upwards to its fixing point 1*i* on the bottom part of the elevator car 1.

The solution according to FIG. 6 is otherwise similar to the solution according to FIG. 5, but now the new hoisting machine 4*a* plus traction sheave 5*a* and diverting pulley 6*a* are disposed in the elevator hoistway above the elevator car 1. The hoisting machine 4*a* plus traction sheave 5*a* and diverting pulley 6*a* are fixed to the suspension beam 2*c*, which is further fixed e.g. to the elevator guide rails 2. The hoisting ropes 1*f* and the compensating ropes 1*g* are suspended in the same way as in the solution according to FIG. 5. The final hoisting ropes 1*f* of the elevator can be completely new ropes or the hoisting ropes 1*f* can also be the installation-time suspension ropes 1*a*.

In the solutions according to FIGS. 5 and 6 the elevator car 1 and the compensating weight 3 are suspended with the suspension ratio 1:1, but the suspension ratio can just as well also be other than 1:1, e.g. 2:1.

In the arrangement according to the invention the traction member 1*b* is separated from the suspension members 1*a* only during use of the elevator while the building is still under construction and after the building has been completed the elevator is converted for normal operation by removing the temporary machine 4, plus traction sheave 5 and diverting pulley 6 and traction member 1*b*, and also by installing the new hoisting machine 4*a* plus traction sheave 5*a* above the elevator car 1.

The method according to the invention for installing an elevator and converting it for final use can be implemented following, for example, the phases hereunder:

1) The first guide rails 2 of the elevator car 1 and the first guide rails of the compensating weight are installed in the elevator hoistway, either just the very lowermost guide rails or e.g. the next to lowermost and the lowermost guide rails, in which case the overall guide rail length is the length of two consecutive guide rails,
2) A temporary hoisting machine 4, plus traction sheave 5 and diverting pulley 6, is installed in the bottom part or on the base of the elevator hoistway,
3) A suspension beam 2*a* with diverting pulleys 7 is fixed to the guide rails 2 of the elevator near the top ends of the guide rails 2,
4) The elevator car 1 and compensating weight 3 are installed onto their guide rails and locked into their position and also the suspension ropes 1*a* are fastened between the compensating weight 3 and the elevator car 1 in such a way that the first ends of the suspension ropes are attached to the compensating weight 3 and the second ends are on the feeder reel 9, which is fixed e.g. to the top part of the elevator car 1,
5) The traction member 1*b* is fixed between the compensating weight 3 and the elevator car 1 in such a way that the first end of the traction member 1*b* is on the feeder reel 10, which is fixed to the compensating weight 3, and the second end is attached to the bottom part of the elevator car 1, and the traction member 1*b* is led to travel under the traction sheave 5 and to receive its motion from the traction sheave 5,
6) The control and electrification of the elevator is installed as also are the overspeed governor 8 and other necessary components, and the elevator is made ready for use during the construction of the building, when the elevator is used normally in the bottom part of the building,
7) When the building rises to a sufficient height, a jump function is performed, in which case the elevator car 1 is first driven upwards as far as possible and at the same time the compensating weight driven downwards as far as possible, and the compensating weight 3 is supported on a buffer or on a separate support base,
8) The elevator is taken out of service,
9) The elevator car 1 is connected, while working on the roof of the car 1, with ropes to the suspension beam 2*a* to be at a suitable distance below suspension beam 2*a*,
10) The auxiliary hoist 11 and its hoisting rope 11*a* are fixed to the suspension beam 2*a* and the auxiliary hoist 11 is suspended on a fixed point in the building with the diverting pulley 11*b*, and also the elevator car 1 is released from the wedges by pressing the pedal 12 of the locking bypass apparatus for the elevator car and by keeping it depressed,
11) The suspension ropes 1*a* and the traction member 1*b* are loosened,
12) The suspension beam 2*a* is detached from the guide rails 2,
13) If necessary, the elevator car 1 is driven downwards a little by means of the auxiliary hoist 11,
14) The suspension beam 2*a* is locked to the guide rails 2 and also the elevator car 1 is locked to the guide rails 2 with the wedges of the safety gear,
15) The guide rails 2 of the elevator and the guide rails of the compensating weight 3 are lifted into their position and fixed one above another in such a way that the travel distance of the elevator car 1 and of the compensating weight 3 can be lengthened,
16) The suspension ropes 1*a* and the traction member 1*b* are released from their locking so that their operating length can be increased from the feeder reels 9 and 10,
17) The auxiliary hoist 11 is fixed to the suspension beam 2*a*, if it has been released for lifting purposes in the previous phases, and the elevator car 1 is released from the wedges by pressing the pedal 12 of the locking bypass apparatus for the elevator car and by keeping it depressed,
18) Using the elevator car 1 and the suspension beam 2*a* that is supported by the auxiliary hoist as lifting platforms, guide rail clamps are fixed for the distance of the height of the jump,
19) The suspension beam 2*a* is lifted to the new height of the jump and at the same time the additional length needed for the suspension ropes 1*a* is taken from the first feeder reel 9 and the additional length needed for the traction member 1*b* is taken from the second feeder reel 10, and also finally the suspension beam 2*a* is locked to the guide rails 2 at the new height of the jump,
20) The feeder reels 9 and 10 are locked so that they do not rotate and also the suspension ropes 1*a* and the traction member 1*b* are locked to their new lengths in such a way that their operating length does not change unintentionally; also, the suspension ropes 1*a* and the traction member 1*b* are tensioned to their operating tautness,
21) The elevator car 1 is detached from the suspension beam 2*a*,
22) The auxiliary hoist 11 is detached from its support and placed in the storage position on the suspension beam 2*a*. In addition, hoisting rope 11*a* for the auxiliary hoist 11 is reserved in storage for the rise in the building,
23) The elevator car 1 can be moved with its own temporary machine 4 on service drive,
24) The final installation procedures are performed using the elevator car 1 as an installation platform,
25) The elevator is switched to normal drive for the construction time of the building,
26) The subsequent necessary jumps according to phases 7-25 are performed until the building is at its final height,
27) The elevator is converted to be suited for normal drive after completion of the building, said conversion comprising e.g. the following phases:
28) When the elevator car 1 and compensating weight 3 are locked in their positions, the new hoisting machine, plus control, electrification, traction sheave 5*a* and diverting pulley 6*a* are installed in a machine room 13 above the elevator hoistway or on the suspension beam 2*c* fixed to the top end of the elevator guide rails 2. The suspension beam 2*c* can be the modified construction-time suspension beam 2*a* or a new and separate suspension beam, 29) The feeder reels 9 and 10 are removed.

30) The hoisting ropes 1*f* are fixed between the elevator car 1 and compensating weight 3 and to receive their moving force from the new traction sheave 5*a*. The hoisting ropes 1*f* can be the suspension ropes 1*a* used in conjunction with installation or new and separate ropes, 31) The temporary hoisting machine 4, plus traction sheave and diverting pulley 6, is removed 32) The compensating rope 1*g*, plus diverting pulleys 6*b*, is fixed to the bottom part of the elevator car 1 and of the compensating weight 3 and to travel under the diverting pulleys 6*b* disposed in the bottom part of the elevator hoistway.

33) The hoisting ropes 1*f* and the compensating ropes 1*g* are tensioned to their operating tautness and installed, and also the other necessary elevator components are adjusted, 34) The elevator car 1 and compensating weight 3 are released for normal drive of the elevator.

This list of the different phases of the method is not exhaustive, neither do all the phases necessarily need to be present or in the sequence presented above. In addition, the phases can be different, and there can be more or fewer of them.

The installation of the elevator can also be implemented in such a way that the elevator hoistway plus elevator car 1, plus guide rails 2 plus compensating weight 3 and plus the temporary hoisting machine 4 with ropes and diverting pulleys are constructed to completion for their whole height, or for almost their whole height, and the building is constructed floor by floor around the elevator hoistway. In this case a jump function is not necessarily needed after a new floor or floors is/are completed, but instead the elevator car 1 is controlled only to travel higher when a new floor has been completed.

When the building is finished, the temporary hoisting machine 4 that is in the bottom part of the elevator hoistway is replaced with a new hoisting machine 4*a* plus traction sheave 5*a* and diverting pulley 6*a* in essentially the same manner as stated in the preceding. In this case, it can be replaced with a new elevator car 1, or the interior decoration of the elevator car that is in the hoistway can be replaced with the final interior decoration, because during the construction time the elevator car 1, or at least its interior decoration, could have been subjected to stress that may have damaged the elevator car 1 or its interior decoration.

It should also be noted that the different solutions presented above can be inventive features together with one or more other features of the invention.

It is obvious to the person skilled in the art that the invention is not limited solely to the examples described above, but that it may be varied within the scope of the claims presented below. Thus, for example, the suspension solutions as well as the number and sequence of the phases of the method can also be different to what is presented above.

The invention claimed is:

1. A method for of installing an elevator during a construction phase of a building, the method comprising:

installing, in the construction phase, a first elevator car adapted to move reciprocally in an elevator hoistway and at least one compensating weight such that the first elevator car and the compensating weight are connected to a suspension beam fixed above the first elevator car by at least one suspension member and diverting pulleys;

installing, in the construction phase, a first hoisting machine provided with at least one first traction sheave at a bottom part of the elevator hoistway the first traction sheave connected to at least one first traction member configured to transmit rotational movement of the first traction sheave into movement of the first elevator car and movement of the compensating weight;

moving, in the construction phase, the first elevator car such that, the first hoisting machine is kept in a same place during the construction phase and support and movement of the first elevator car are separated from each other; and converting, after the construction phase, the elevator to normal operation when the building is at its final height, the converting including removing the first hoisting machine along with the first traction sheave and the first traction member associated therewith from the bottom part of the elevator hoistway, and installing a second hoisting machine at a top part of the elevator hoistway along with a second traction sheave and a hoisting rope.

2. The method according to claim 1, wherein the moving comprises:

lifting, during the construction phase, the first elevator car, together with the suspension beam, via a so-called jump function to a new height position after each phase of completion of the building.

3. The method according to claim 1, wherein the converting installs the second hoisting machine such that the second hoisting machine and the second traction sheave are above the first elevator car and the first elevator car is connected to the compensating weight by the hoisting rope such that a first end of the hoisting rope is fixed to the compensating weight, a middle portion of the hoisting rope is led from the compensating weight upwards, around the second traction sheave that is above the first elevator car, downwards to the first elevator car, and a second end of the hoisting rope is fixed to the first elevator car.

4. The method according to claim 1, further comprising:

modifying, after the construction phase, the first elevator car with interior decor renewed and connecting the first elevator car to the compensating weight via the hoisting rope.

5. The method according to claim 1, further comprising:

replacing, after the construction phase, the first elevator car with a second elevator car by connecting the second elevator car to the compensating weight via the hoisting rope.

6. The method according to claim 1, wherein the converting comprises:

installing the second hoisting machine and the second traction sheave in a machine room above the elevator hoistway.

7. The method according to claim 1, wherein the converting comprises:

installing the second hoisting machine and the second traction sheave on the suspension beam in the top part of the elevator hoistway, the suspension beam being fixed to guide rails of the elevator.

8. The method according to claim 7, wherein the converting comprises:

modifying the suspension beam utilized during the construction phase for use during the normal operation.

9. The method according to claim 1, wherein the converting comprises:

modifying the at least one suspension member utilized during the construction phase as the hoisting rope used during the normal operation.

10. A method of installing an elevator during construction of a building and converting the elevator to normal use after construction of the building, the method comprising:

a) installing a section of the elevator during construction of the building by, installing guide rails associated with an elevator car and a compensating weight in an elevator hoistway, installing a temporary hoisting machine, a temporary traction sheave, and a temporary diverting pulley in a base of the elevator hoistway, fixing a temporary suspension beam to top ends of the guide rails, the temporary suspension beam having diverting pulleys attached thereto, installing the elevator car and the compensating weight to respective ones of the guide rails such that the elevator car and the compensating weight are locked into a fixed position, fastening suspension ropes between the compensating weight and the elevator car such that a first end of the suspension ropes are attached to the compensating weight and a second end of the suspension ropes are attached to a suspension feeder reel, the suspension feeder reel being fixed to a top of the elevator car, fastening a traction member between the compensating weight and the elevator car such that a first end of the traction member is attached to a traction feeder reel and a second end of the traction member is attached to a bottom of the elevator car with a middle portion of the traction member being led to travel under the temporary traction sheave to receive motion from the temporary traction sheave, the traction feeder reel being fixed to the compensating weight, and electrifying the elevator to utilize the elevator during construction of the; and converting the elevator to normal drive after completion of the building by, locking the elevator car and compensating weight in position, installing a new hoisting machine, a new traction sheave and a new diverting pulley above the elevator hoistway in a machine room or on the temporary suspension beam fixed to the top of the elevator guide rails, removing the suspension feeder reel and the traction feeder reel, installing hoisting ropes between the elevator car and the compensating weight, removing the temporary hoisting machine, the temporary traction sheave and the temporary diverting pulley, fixing a compensating rope to a bottom of the elevator car and to the compensating weight such that the compensating rope travels under a second new diverting pulley disposed in the base of the elevator hoistway, and releasing the elevator car and compensating weight for normal drive.

11. The method of claim 10, further comprising:

performing, prior to converting the elevator to the normal drive, a jump lift after installing the section of the elevator by, connecting the elevator car to the temporary suspension beam while the elevator car is at a distance below the temporary suspension beam, extending a length of the guide rails upwards in the elevator hoistway, releasing the suspension ropes and the traction member to increase operating lengths thereof via respective ones of the suspension feeder reel and the traction feeder reel, lifting the temporary suspension beam via an auxiliary hoist suspended on a fixed point in the building with a diverting pulley and locking the temporary suspension beam at a new height, locking the suspension feeder reel and the traction feeder reel such that the operating lengths of the suspension ropes and the traction member are locked, and disconnecting the elevator car from the temporary suspension beam to allow the elevator car to move via the temporary hoisting machine.

* * * * *